US009926050B1

(12) United States Patent
Cinanni

(10) Patent No.: US 9,926,050 B1
(45) Date of Patent: Mar. 27, 2018

(54) KAYAK STABILIZING DEVICE

(71) Applicant: Mary Ann Cinanni, Guelph (CA)

(72) Inventor: Mary Ann Cinanni, Guelph (CA)

( * ) Notice: Subject to any disclaimer, the term of this patent is extended or adjusted under 35 U.S.C. 154(b) by 0 days.

(21) Appl. No.: 15/431,254

(22) Filed: Feb. 13, 2017

Related U.S. Application Data

(60) Provisional application No. 62/294,089, filed on Feb. 11, 2016.

(51) Int. Cl.
*B63B 35/71* (2006.01)
*B63H 16/04* (2006.01)

(52) U.S. Cl.
CPC ..... *B63B 35/71* (2013.01); *B63H 16/04* (2013.01); *B63B 2035/715* (2013.01)

(58) Field of Classification Search
CPC ... B63B 35/71; B63B 2035/715; B63B 43/14; B63H 16/04
USPC ..... 114/347, 360
See application file for complete search history.

(56) References Cited

U.S. PATENT DOCUMENTS

| | | | | |
|---|---|---|---|---|
| 3,150,386 | A * | 9/1964 | Bastien | B63B 5/24 114/347 |
| D367,032 | S | 2/1996 | Fentress et al. | |
| 6,027,387 | A * | 2/2000 | Allin | B63B 17/00 114/364 |
| D440,536 | S | 4/2001 | Grzybowski | |
| 6,247,981 | B1 * | 6/2001 | Farley | B63H 1/04 114/123 |
| 6,860,216 | B1 | 3/2005 | Morriseau | |
| 6,928,949 | B1 | 8/2005 | Simon | |
| 7,334,534 | B2 | 2/2008 | Cameron | |
| 7,789,035 | B1 | 9/2010 | Rosenberg et al. | |
| 8,915,207 | B2 * | 12/2014 | Wirsig | B63B 39/00 114/364 |
| 9,695,798 | B2 * | 7/2017 | Deale | F03D 1/02 |
| 2004/0255836 | A1 * | 12/2004 | Hopkins | B63B 35/71 114/347 |
| 2012/0216739 | A1 | 8/2012 | Mauer | |

* cited by examiner

*Primary Examiner* — Anthony D Wiest
(74) *Attorney, Agent, or Firm* — Robert C. Montgomery; Montgomery Patent & Design L.P.

(57) ABSTRACT

A stabilizing device includes a double-ended paddle having an intermediate coupling. The stabilizing device is inserted into a channel running perpendicularly through a hull of a kayak which is configured to accommodate the stabilizing device.

20 Claims, 6 Drawing Sheets

KAYAK STABILIZING DEVICE

RELATED APPLICATIONS

The present invention is a continuation-in-part of, was first described in and claims the benefit of U.S. Provisional Application No. 62/294,089 filed Feb. 11, 2016, the entire disclosures of which are incorporated herein by reference.

FIELD OF THE INVENTION

The present invention relates generally to the field of stabilizing devices used specifically for entering a kayak.

BACKGROUND OF THE INVENTION

Recreational boating has earned a well-deserved spot of the list of favorite pastimes of countless people. The ability to get outside and enjoy warm weather, sunshine, and water make all kinds of boating truly enjoyable. Many people turn to the use of a kayak to get out on the water especially when fishing, or just exploring local waterways and lakes when camping. While a kayak is relatively easy to get in and out of when it is near shore or a dock, it is almost impossible to do so when out in the middle of a body of water. The kayaker may want to take a cooling dip, need to stretch his or her legs or back, retrieve something that fell out of the kayak, or even to stand and cast while fishing. Whatever the reason, getting back in without filling the kayak with water is almost impossible. Accordingly, there exists a need for a means by which a user can exit and enter a kayak in the middle of a body of water without the problems as described above. The use of the kayak stabilizing device provides kayakers the ability to easily exit their kayak in the middle of a body of water and climb back in just as easily.

SUMMARY OF THE INVENTION

The inventor has recognized the aforementioned inherent problems and lack in the art and observed that there is a need for stabilizing devices used specifically for entering a kayak.

It is therefore an object of the invention to provide a stabilization device which comprises a kayak hull, a channel disposed through the kayak hull and a paddle which is adapted to be inserted into the channel. The kayak hull has a kayak top and bottom half, a cockpit which is disposed within the kayak top half and adjacent to a widthwise centerline of the kayak hull, a keel which is disposed along the kayak bottom half contiguously along a lengthwise centerline of the kayak hull and a deck. The kayak top half and bottom half are separated by a water line when the kayak rests upon a water surface. The channel has a first end and a second end. The channel is perpendicular to the lengthwise centerline while being adjacent the widthwise centerline opposite the cockpit. The channel is also disposed at the waterline of the kayak hull between the keel and the deck. When the paddle is inserted into the channel, the kayak hull when positioned upon the water surface is steadied by movements of a user against clockwise or counter-clockwise rotation about the lengthwise centerline.

The channel may be cylindrical while the paddle may comprise of a pair of blades, each disposed at distal ends of a shaft. The paddle may also comprise of a first paddle section which has a first distal paddle end and a first proximal joint end and a second paddle section which has a second distal paddle end and a second proximal joint end. The first paddle section proximal joint end and second paddle section proximal joint end are capable of being removably secured to each other.

The first proximal joint end and the second proximal joint end may comprise a joining means which is capable of being fit together at common joints. The joining means may further comprise a male threaded feature secured to the first proximal joint end and a female threaded feature secured to the second proximal joint end. The male threaded feature and female threaded feature are configured to threadingly engage.

The kayak top half may further comprise a front hatch which is adjacent the cockpit and a back hatch which is adjacent the widthwise center line opposite the cockpit. The kayak top half may further comprise a plurality of deck bungees disposed about the top half. A handle may be provided at either end of the kayak.

In a separate embodiment, the first channel end of the channel may have a keyway while the paddle may have a key which is adapted for insertion into the keyway of the channel. In this embodiment, when the kayak hull is positioned upon the water surface and the key is inserted into the keyway, the pair of paddle blades are oriented perpendicular to the water surface.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
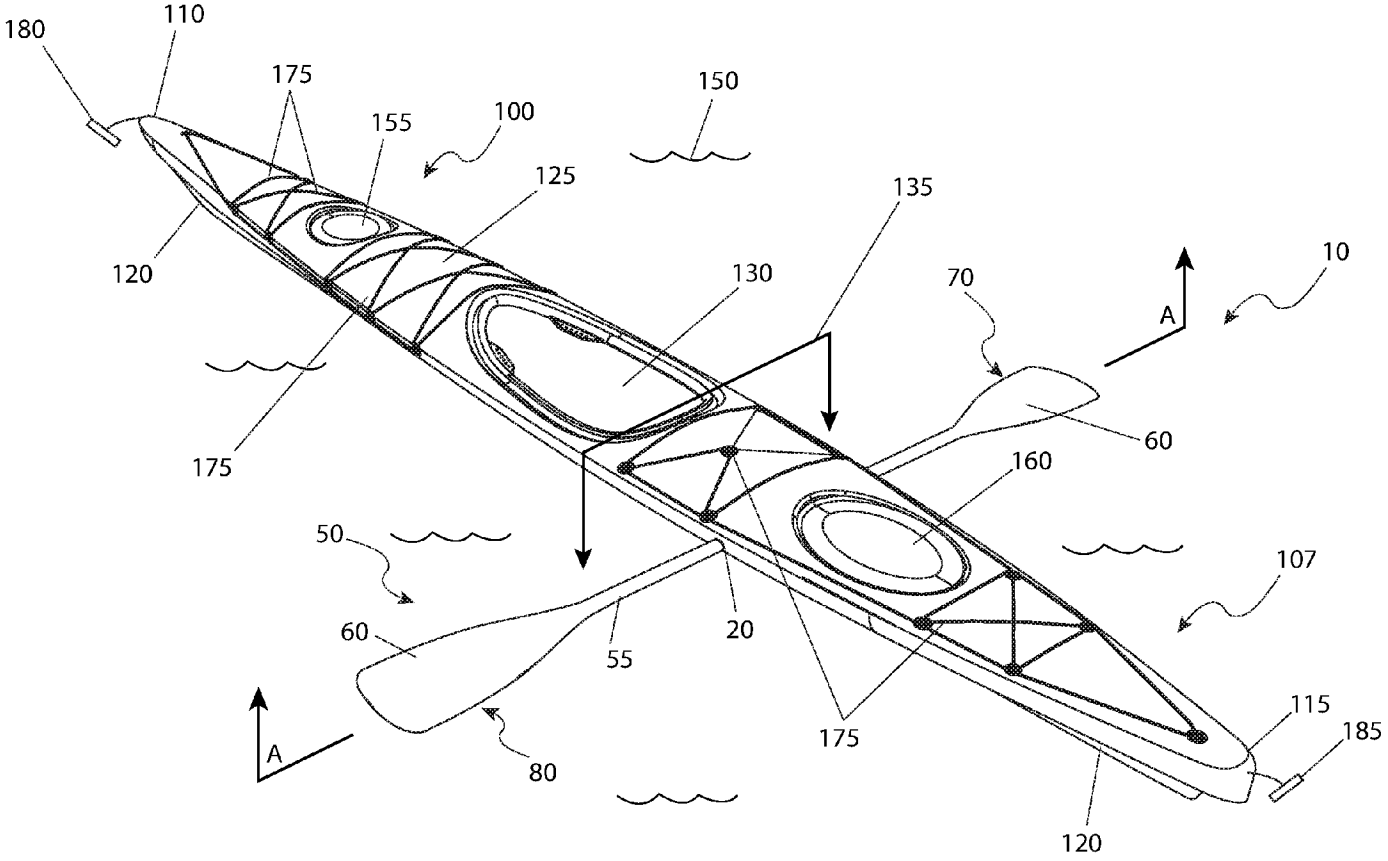
FIG. 1 is a perspective top view of a kayak 100 with a paddle 50 inserted through a channel 20 incorporated into a portion of a hull top 107 to function as a stabilization device 10 in accordance with the preferred embodiment of the present invention.

10 stabilization device
20 channel
25 channel first end
30 channel second end
35 tube wall
40 cavity
45 keyway
50 paddle
55 shaft

60 blade
65 joint
70 first paddle section
75 male threaded end
80 second paddle section
85 female threaded end
90 key
100 kayak
105 hull bottom
107 hull top
110 bow
115 stern
120 keel
125 deck
130 cockpit
135 widthwise center line
140 lengthwise center line
150 water line
155 front hatch
160 back hatch
175 deck bungee
180 first carry handle
185 second carry handle

DETAILED DESCRIPTION OF THE PREFERRED EMBODIMENT

The best mode for carrying out the invention is presented in terms of its preferred embodiment, herein depicted within FIGS. 1 through 6. However, the invention is not limited to the described embodiment, and a person skilled in the art will appreciate that many other embodiments of the invention are possible without deviating from the basic concept of the invention and that any such work around will also fall under the scope of this invention. It is envisioned that other styles and configurations of the present invention can be easily incorporated into the teachings of the present invention, and only one (1) particular configuration shall be shown and described for purposes of clarity and disclosure and not by way of limitation of scope.

The terms "a" and "an" herein do not denote a limitation of quantity, but rather denote the presence of at least one (1) of the referenced items.

The present invention describes a stabilization device (herein referred to as the "system") 10, which provides a means to stabilize a kayak 100 against capsizing in open water along water line 150 when a user attempts to depart from, or re-enter, a cockpit 130 of that kayak 100. While the preferred embodiment of this system 10 is promoted as being incorporated into the design of a new kayak 100, it is understood that a capable user may elect to install the various components, in part, or in whole, into an existing kayak 100 and remain within the teachings and the scope of this system 10. It should be noted that variability exists in the design of different models of kayaks 100 and that the sizes and styles of paddles 50 utilized as a propulsion tool is dependent upon certain biological data and the taste of a user. Therefore, a range of sizes, and/or styles, must be implicit in the preferred embodiments without limiting the scope of the invention.

Figure 2:
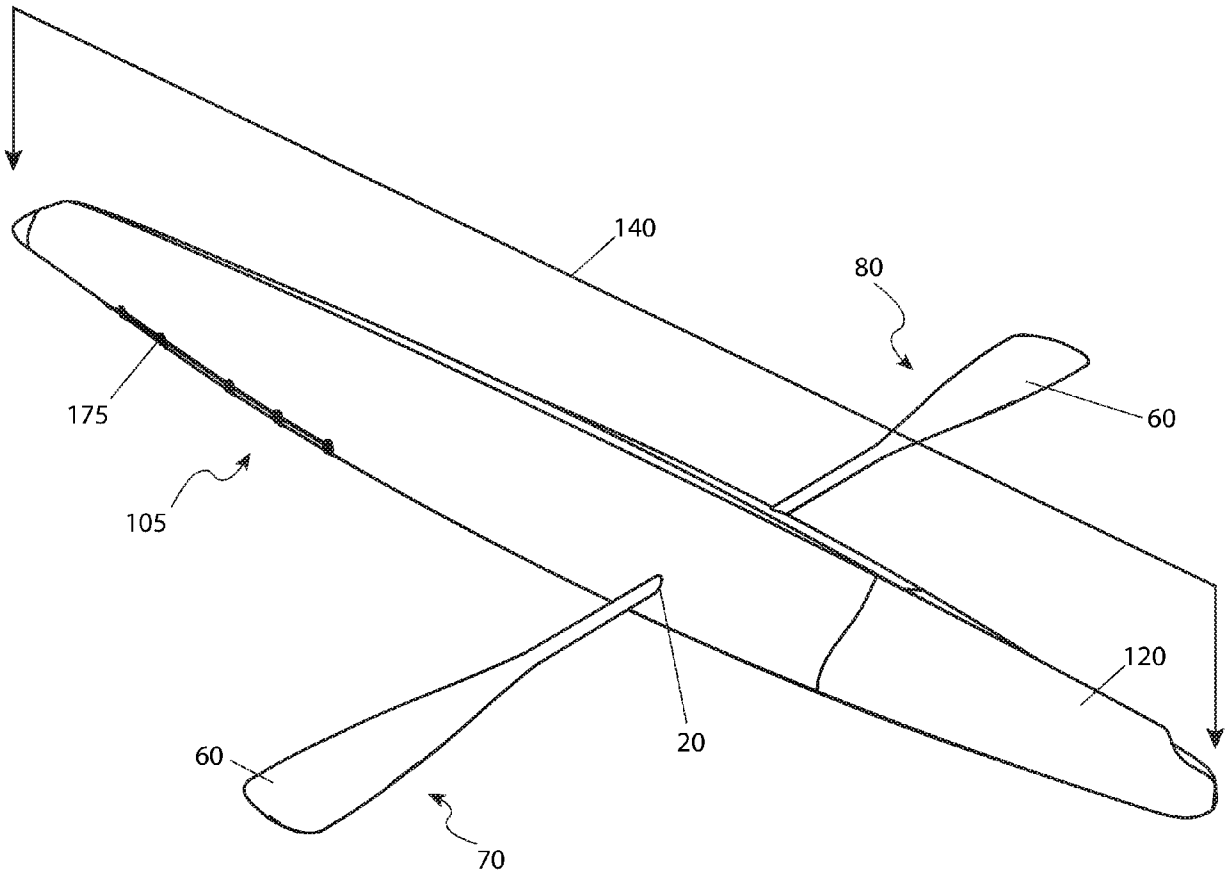
FIG. 2 is a perspective bottom view of a kayak 100 with a paddle 50 inserted through the channel 20 incorporated into a portion of a hull bottom 105 to function as the stabilization device 10 in accordance with the preferred embodiment of the present invention.
Figure 3:
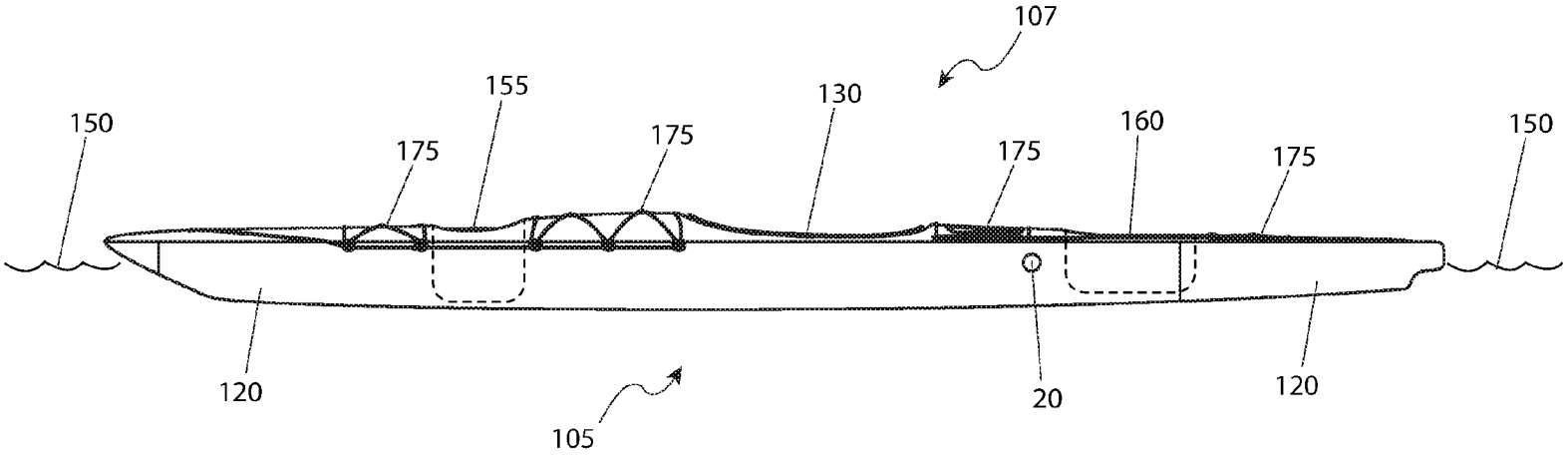
FIG. 3 is a side elevation view of a kayak 100 with the channel 20 incorporated in between a portion of a hull top 107 and hull bottom 105 to function as the stabilization device 10 in accordance with the preferred embodiment of the present invention.
Figure 4:
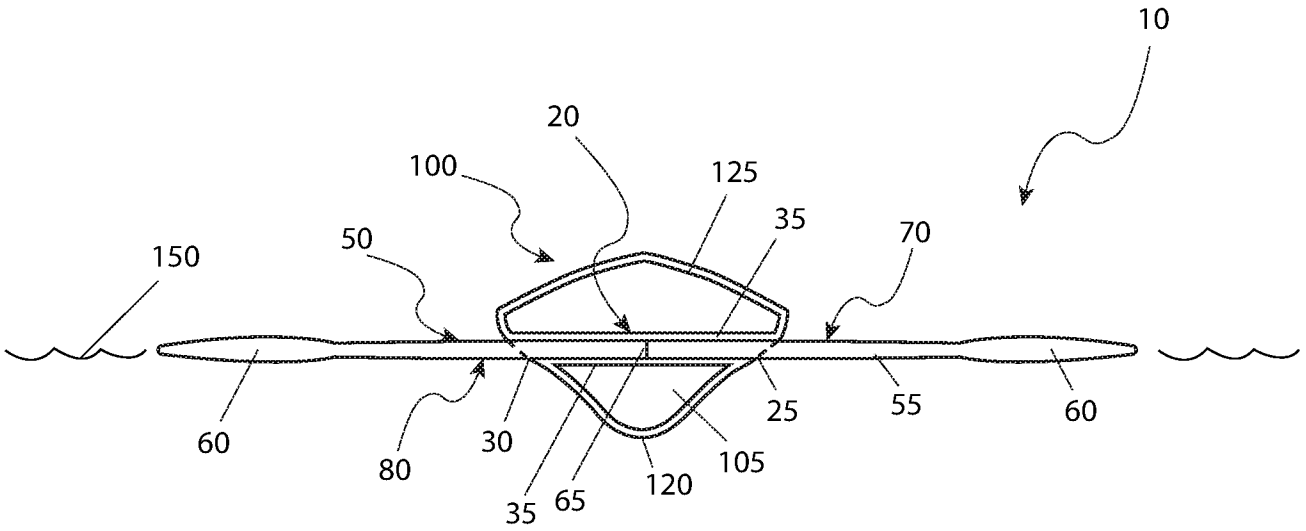
FIG. 4 is a section view along a line A-A as shown on FIG. 1 of the stabilization device 10 in accordance with the preferred embodiment of the present invention.

Referring now to FIG. 1, a top perspective view of an exemplary kayak 100 equipped with the system 10, FIG. 2, a bottom perspective view of an exemplary kayak 100 equipped with the system 10, FIG. 3, a side elevation view of an exemplary kayak 100 showing channel 20 and FIG. 4, a section view along line A-A, as seen in FIG. 1, according to the preferred embodiment of the present invention, are disclosed. The system 10 includes a channel 20 built between a hull bottom 105 and a hull top 107 of a kayak 100 and a paddle 50 adapted for insertion into an interior cavity 40 of that channel 20. The kayak 100 is any watercraft falling into the classification of a sea, or touring kayak 100 fabricated of any material of current technology. The kayaks 100 of this classification are customarily provided with a cockpit 130 located along a hull top 107 between a bow 110 and a stern 115. A user occupies the cockpit 130 while navigating the kayak 100.

The channel 20 is a cylindrical tube extending from a channel first end 25 to a channel second 30 fabricated into and between the hull bottom 105 and the hull top 107 of the kayak 100 perpendicular to the longitudinal axis thereof. It is understood that other geometric shapes, such as rectangular polygons, may be utilized without limiting the scope of the system 10. The channel 20 may be composed of a polymer, or other material, such as fiberglass or carbon fiber-reinforced epoxy, commensurate with the materials of construction of the kayak 100. The channel 20 has a tube wall 35 encircling an internal cavity 40. The channel 20 is configured to be attached between the hull bottom 105 and a hull top 107 in such a manner as to obviate the introduction of water into the hull bottom 105 and the hull top 107 at any time. The channel 20 is preferably located at a point just aft of the cockpit 130 opposite the widthwise center line 135 of the kayak 100 that is easily accessible to a user. The channel 20 is further located at approximately a level of water line 150 between a keel 120, disposed along a lengthwise center line 140 and a deck 125. A front hatch 155, comprising a cavity and lid within the deck 125 adjacent the bow 110, provides an interior storage cavity within the kayak 100. A back hatch 160, comprising a cavity and lid within the deck 125 adjacent the stern 115, likewise provides an interior storage cavity within the kayak 100. A plurality of deck bungee cords 175 are disposed across the deck 125 and provide a means of temporarily securing various and sundry items beneath the same. A first carry handle 180 is secured at the bow 110 while a second carry handle 185 is secured at the stern.

Figure 5:
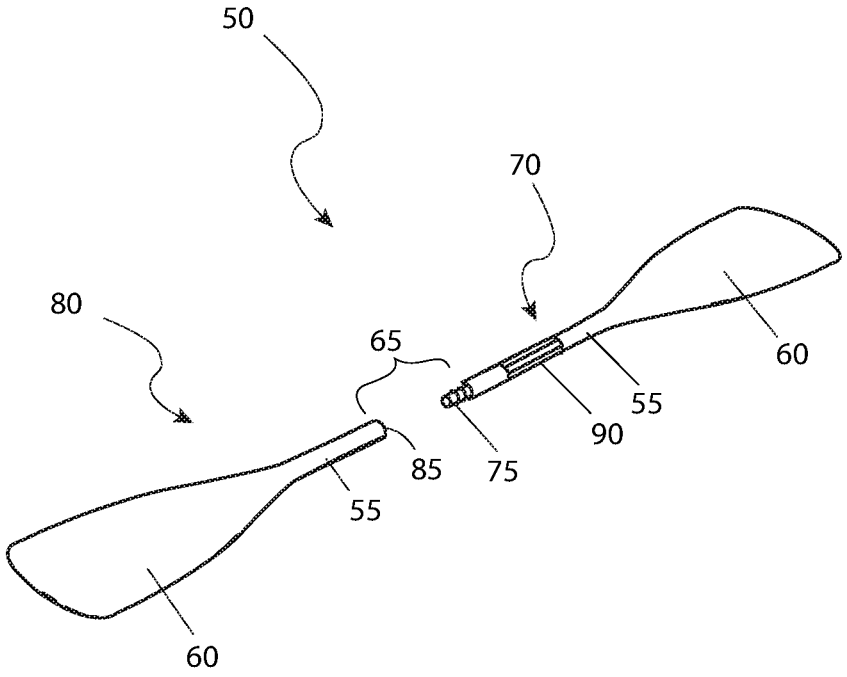
FIG. 5 is an isolated view of a paddle 50 separated at a joint 65 in accordance with the preferred embodiment of the present invention; and, FIG. 6 is an isolated view of a channel first end 25 of the stabilization device 10 in accordance with the preferred embodiment of the present invention.

Referring now to FIG. 5, an isolated view of a paddle 50 of the system 10, according to the preferred embodiment of the present invention, is disclosed. The paddle 50 is configured to be a hand-held propulsion device having a broad, flat blade 60 disposed at either end of a central shaft 55. The paddle 50 is composed of a plurality of fiberglass reinforced epoxy pieces configured to be assembled at a joint 65. Other materials, such as a variety of polymers, Kevlar®, or carbon fibers, may be utilized in the fabrication of the paddle 50 without limiting the scope of the system 10. In a preferred embodiment, the joint 65 is provided with a male threaded end 75 on a first paddle section 70 and a female threaded end 85 on a second paddle section 80. The paddle sections 70, 80 are configured to be assembled by engaging the male threaded end 75 entirely within the female threaded end 85.

The paddle sections 70, 80 are assembled at the joint 65 and utilized in a standard fashion for the propulsion and steering of the kayak 100. As a stabilization device 10, the paddle 50 is disassembled at the joint 65 by removing the male threaded end 75 from the female threaded end 85. The first paddle section 70 is inserted into the channel first end 25 while the second paddle section 80 is inserted within the channel second end 30. The male threaded end 75 is reengaged into the female threaded end 85 within the cavity 40. The paddle 50 is oriented with the width of the blades 60 parallel to the surface of the water. In this manner, any tipping force, and subsequent moment, exerted by the user moving away from a center of gravity of the kayak 100 will be counteracted by a force exerted by the water upon the blade 60 of the paddle 50 on an opposite side.

Figure 6:
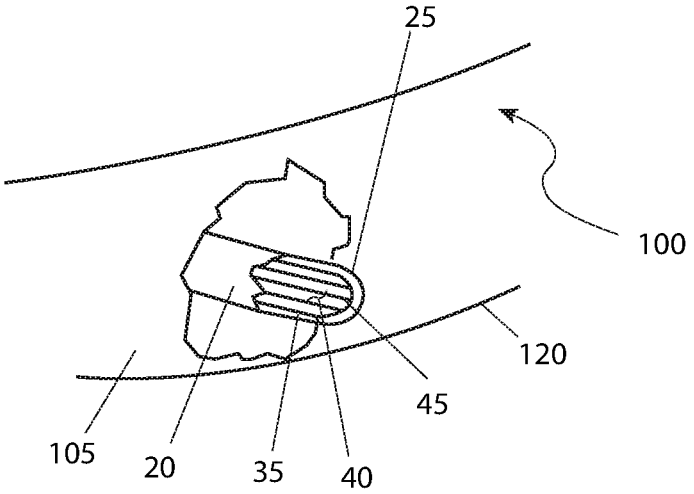

Referring now to FIG. 6, a channel first end 25 of the system 10, according to the preferred embodiment of the present invention, is disclosed. A portion of the internal cavity 40 of the channel 20 may be provided with a keyway 45 to positively secure the paddle 50 in a preferred configuration with the blades 60 oriented perpendicularly to the surface of the water line 150. This keyway 45 may be any geometric pattern formed into the cavity of the channel 20 that coincides with a similar pattern of a key 90 formed into the shaft 55 of the first paddle section 70. An exemplary key 90 is illustrated on the shaft 55 of the paddle 50 depicted in FIG. 5.

The preferred embodiment of the present invention can be utilized by an enabled individual in a simple and straightforward manner with little or no training. After initial purchase or acquisition of the system 10, it would be installed as indicated in FIG. 1. The method of utilizing the system 10 has been detailed in the previous discussion.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. A stabilization device, comprising:

a kayak hull comprising:

a kayak top half;

a kayak bottom half;

a cockpit disposed within said kayak top half adjacent a widthwise centerline of said kayak hull;

a keel disposed along said kayak bottom half contiguously along a lengthwise centerline of said kayak hull; and, a deck;

wherein said kayak top half and said kayak bottom half are divided by a waterline when said kayak hull is positioned upon a water surface;

a channel disposed through said kayak hull, further having a first channel end located at a first side of said kayak hull and a second channel end located at a second side of said kayak hull;

wherein said channel is perpendicular to said lengthwise centerline;

wherein said channel is adjacent said widthwise centerline opposite said cockpit; and, wherein said channel is disposed at said waterline of said kayak hull between said keel and said deck;

a paddle adapted for insertion into said channel;

wherein when said paddle is inserted into said channel, said kayak hull when positioned upon said water surface is steadied by movements of a user against clockwise or counter-clockwise rotation about said lengthwise centerline.

2. The stabilization device of claim 1, wherein said channel is cylindrical.

3. The stabilization device of claim 1, wherein said paddle further comprises a pair of blades, each disposed at distal ends of a shaft.

4. The stabilization device of claim 3, wherein said paddle further comprises:

a first paddle section having a first distal paddle end and a first proximal joint end; and, a second paddle section having a second distal paddle end and a second proximal joint end;

wherein said first proximal joint end and second proximal joint end are capable of being removably secured to each other.

5. The stabilization device of claim 4, wherein said first proximal joint end and said second proximal joint end comprises a joining means capable of being fit together at common joints.

6. The stabilization device of claim 5, wherein said joining means comprises a male threaded feature secured to said first proximal joint end and a female threaded feature secured to said second proximal joint end;

wherein said male threaded feature and female threaded feature are configured to threadingly engage.

7. The stabilization device of claim 1, wherein said kayak top half further comprises a front hatch disposed therewithin and adjacent said cockpit.

8. The stabilization device of claim 7, wherein said kayak top half further comprises a back hatch disposed therewithin and adjacent said widthwise center line opposite said cockpit.

9. The stabilization device of claim 8, wherein said kayak top half further comprises a plurality of deck bungees disposed thereacross.

10. The stabilization device of claim 8, wherein said kayak hull further comprises a handle disposed at a bow and a stern thereof.

11. A stabilization device, comprising:

a kayak hull comprising:

a kayak top half;

a kayak bottom half;

a cockpit disposed within said kayak top half adjacent a widthwise centerline of said kayak hull;

a keel disposed along said kayak bottom half contiguously along a lengthwise centerline of said kayak hull; and, a deck;

wherein said kayak top half and said kayak bottom half are divided by a waterline when said kayak hull is positioned upon a water surface;

a channel disposed through said kayak hull, further having a first channel end located at a first side of said kayak hull having a keyway and a second channel end located at a second side of said kayak hull;

wherein said channel is perpendicular to said lengthwise centerline;

wherein said channel is adjacent said widthwise centerline opposite said cockpit; and, wherein said channel is disposed at said waterline of said kayak hull between said keel and said deck;

a paddle having a key adapted for insertion into said keyway of said channel;

wherein when said paddle is inserted into said channel, said kayak hull when positioned upon said water surface is steadied by movements of a user against clockwise or counter-clockwise rotation about said lengthwise centerline.

12. The stabilization device of claim 11, wherein said channel is cylindrical.

13. The stabilization device of claim 11, wherein said paddle further comprises a pair of blades, each disposed at distal ends of a shaft.

14. The stabilization device of claim 13, wherein said paddle further comprises:

a first paddle section having a first distal paddle end and a first proximal joint end;

and, a second paddle section having a second distal paddle end and a second proximal joint end;

wherein said first proximal joint end and second proximal joint end are capable of being removably secured to each other;

wherein said key is disposed along a portion of said first paddle section; and, wherein said kayak hull is positioned upon said water surface and said key is inserted into said keyway, said pair of blades are oriented perpendicular to said water surface.

15. The stabilization device of claim 14, wherein said first proximal joint end and said second proximal joint end comprises a joining means capable of being fit together at common joints.

16. The stabilization device of claim 15, wherein said joining means comprises a male threaded feature secured to said first proximal joint end and a female threaded feature secured to said second proximal joint end;

wherein said male threaded feature and female threaded feature are configured to threadingly engage.

17. The stabilization device of claim 11, wherein said kayak top half further comprises a front hatch disposed therewithin and adjacent said cockpit.

18. The stabilization device of claim 17, wherein said kayak top half further comprises a back hatch disposed therewithin and adjacent said widthwise center line opposite said cockpit.

19. The stabilization device of claim 18, wherein said kayak top half further comprises a plurality of deck bungees disposed thereacross.

20. The stabilization device of claim 18, wherein said kayak hull further comprises a handle disposed at a bow and a stern thereof.

* * * * *